United States Patent [19]

Bittel

[11] Patent Number: 5,018,409

[45] Date of Patent: May 28, 1991

[54] TEAR TOP CAN OPENER

[76] Inventor: John A. Bittel, 85 Park Dr. North, Staten Island, N.Y. 10314

[21] Appl. No.: 592,666

[22] Filed: Oct. 4, 1990

[51] Int. Cl.[5] ..... B67B 7/40

[52] U.S. Cl. ..... 81/3.55; D8/18

[58] Field of Search ..... 81/3.55, 3.57, 3.4; D8/18, 33, 40

[56] References Cited

U.S. PATENT DOCUMENTS

| | | | |
|---|---|---|---|
| D. 240,188 | 6/1976 | Lytle | D8/18 |
| D. 267,925 | 2/1983 | LaMancuss | D8/40 |
| 3,656,375 | 4/1972 | Reed et al. . | |
| 3,724,297 | 4/1973 | Bucko . | |
| 4,120,216 | 10/1978 | Goldberg | 81/3.57 |
| 4,167,056 | 9/1979 | Nattel | 81/3.55 |
| 4,207,781 | 6/1980 | Greenwood . | |
| 4,287,794 | 9/1981 | Kubach et al. . | |
| 4,309,921 | 1/1982 | Miller . | |
| 4,362,071 | 12/1982 | Coker . | |
| 4,391,167 | 7/1983 | Bergmeister . | |
| 4,583,429 | 4/1986 | Kroeger | 81/3.55 |

FOREIGN PATENT DOCUMENTS

| | | | |
|---|---|---|---|
| 3517310 | 11/1986 | Fed. Rep. of Germany | 81/3.55 |

*Primary Examiner*—Roscoe V. Parker

*Attorney, Agent, or Firm*—N. J. Aquilino

[57] ABSTRACT

A tear top can opener for opening the closure of a container having a pull ring located adjacent the peripheral edge of the container including a handle, an opener end formed with a finger perpendicular to the longitudinal axis of the opener for engaging the pull ring and a bulbous body having a parabolic shaped edge for allowing the opener to be pivoted on the container in order to lift the pull ring vertically to open the closure.

4 Claims, 1 Drawing Sheet

TEAR TOP CAN OPENER

BACKGROUND OF THE INVENTION

The present invention relates to a tear open can opener, and more particularly to a can opener for use with ring-type opening tabs.

Ring-type opening tabs are used on a variety of canned goods including soft drinks, beverages and other canned foods which all are designed to be opened manually using the fingers where can openers and other opening utensils are not available. These types of cans require that the closure be opened by pulling the tab ring upwardly, thereby initially separating the closure from the can and pulling the ring in a direction along a tear line to completely remove the closure from the can. However, many of these openers are difficult to open for various consumers, either because of the lack of strength of the individual, or the difficulty in inserting a finger or fingernail under the ring to obtain the necessary leverage.

Among the prior art patents directed to can openers to remove the lids from tear top cans are the patents to Coker U.S. Pat. No. 4,362,071, the patent to Reed et al U.S. Pat. No. 3,656,375, the patent to Bucko U.S. Pat. No. 3,724,297, the patent to Goldberg U.S. Pat. No. 4,120,216, the patent to Greenwood U.S. Pat. No. 4,207,781, the patent to Kubach et al U.S. Pat. No. 4,287,794, the patent to Miller U.S. Pat. No. 4,309,921, the patent to Bergmeister U.S. Pat. No. 4,391,167 and the patent to Kroeger et al U.S. Pat. No. 4,583,429. The prior art can opener patents, particularly the Coker patent, are designed to open beverage cans where the pull tab is centrally located on the top of the can, however, these designs do not lend themselves to opening of food cans where the ring is located adjacent the edge of the can.

SUMMARY OF THE INVENTION

The present invention is a can opener for removing the entire top from food cans where the ring-type opener tab is located adjacent the edge of the top of the can. In these types of cans, the ring-type opener is integrally attached to a removable lid portion defined by a weakened tear line around the inner periphery of the top of the can. With this structure, the ring must be engaged at the edge of the can and pulled straight up, 90 degrees to the can, in order to be able to fracture the weakened portion of the can top near the edge of the can. Once the top is initially separated, it must continue to be raised upwardly and rearwardly to completely remove it from the top of the can.

The opener includes an elongated handle, a bulbous body portion having a parabolic pivoting edge and an opener end which includes a ring tab engaging finger located at and formed by a slot adjacent the edge of the opener end. The finger member is designed to fit under the ring tab so it may be slid into the slot in order to lift the ring vertically when the opener is pivoted on the parabolic pivoting edge during the opening process. The lifting of the ring in approximately a 90 degree direction from the top of the can initially severs the lid and continued displacement of the lid along the weakened tear line removes the lid. A key feature of the invention is the fact that the slot is positioned at 90 degrees to the longitudinal axis of the opener in combination with the parabolic pivoting edge on the bulbous body. This structure permits the opener to lift the lid of the can straight up and subsequently completely off of the can top as the opener is pivoted on the container top.

Among the objects of the present invention is to provide a can opener for ring-type opener tabs located adjacent the peripheral edges of a container which aids in completely removing tear top lids from food or beverage cans.

Another object is to provide a can opener for ring-type opener tabs which can be used by any variety of persons with variable physical characteristics and strength by using the natural mechanical advantages provided by the opener structure.

Another object is to provide a can opener which is simple in structure and easy to use to completely remove "tear-off" lid can structures.

These and other objects of the invention will become clear from the following description of drawings and preferred embodiments.

DESCRIPTION OF THE PREFERRED EMBODIMENTS

Figure 1:
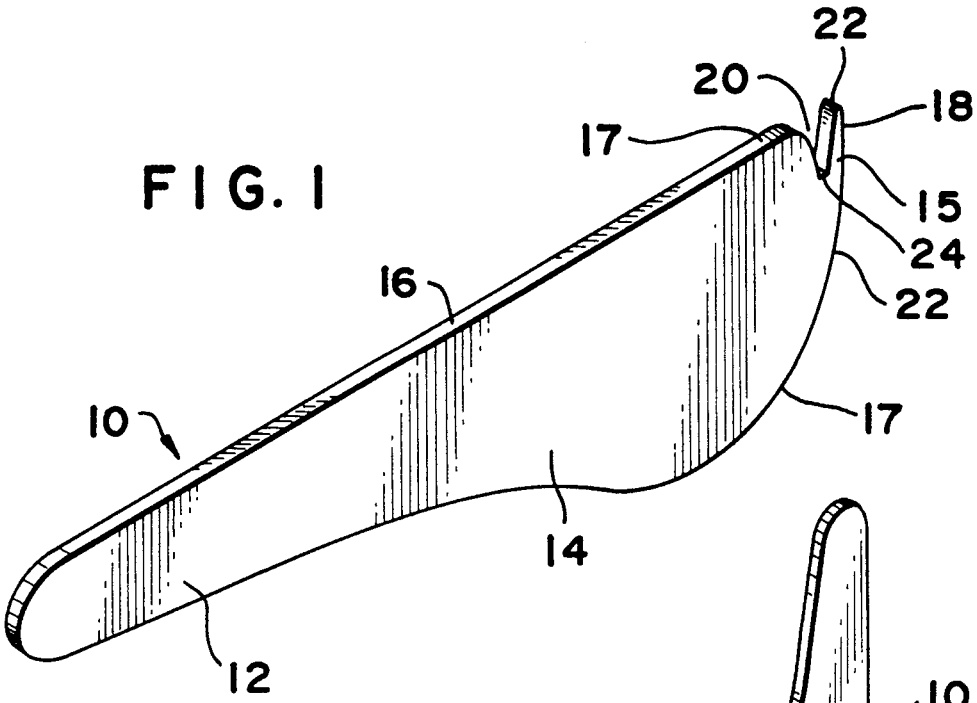
FIG. 1 is an elevational view of the can opener of the present invention.

The present invention relates to a pull-ring type can opener specifically designed to open food or beverage cans where the pull ring on the can top is located adjacent the peripheral edge of the can. This requires that the pull ring be lifted vertically in order to break the weakened score line to remove the lid. The can opener is particularly useful for food cans where the lid is completely removeable in order to gain access to the contents of the can, such as canned meats, pet foods, nuts, soups, puddings and a host of other foods.

Referring to the drawings, the can opener 10 of the present invention includes a handle end 11 with a handle 12, an intermediate, bulbous body portion 14 and an opener end 15. The upper edge 16 of the body portion 14 of the can opener 10 is preferably straight and parallel to the longitudinal axis of the opener 10, whereas the bottom of the bulbous body portion is parabolic in shape and forms a pivoting edge 17 along its periphery which rides on the container top during the opening process as described hereinbelow.

The opener end 15 of the can opener 10 includes an outer edge 18. A slot 20 is located adjacent the outer edge 18 and defines a pull ring engaging finger 22. The outer edge 18 is preferably flattened in order to facilitate the insertion of the finger 22 under the pull ring which normally lies flat against the top of the can. One end of the parabolic shaped pivoting edge 17 extends to be coincident with the handle 12 of the opener 10, whereas the other end of the pivoting edge 17 extends to be coincident with the opener end outer edge 18. As can be seen in the drawings, the radius of the parabolic pivoting edge 17 gradually decreases from the handle 12 toward the opener end 15.

The slot 20 and the finger 22 formed thereby are oriented at a 90 degree angle with respect to the longitudinal axis of the can opener 10. This is a key feature of the structure of the invention in combination with the parabolic pivoting edge 17 as described hereinbelow.

Figure 2:
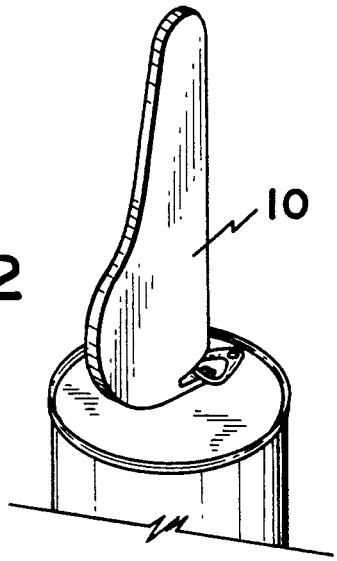
FIGS. 2, 3 and 4 illustrate the can opener in various stages of use opening a container closure.
Figure 3:
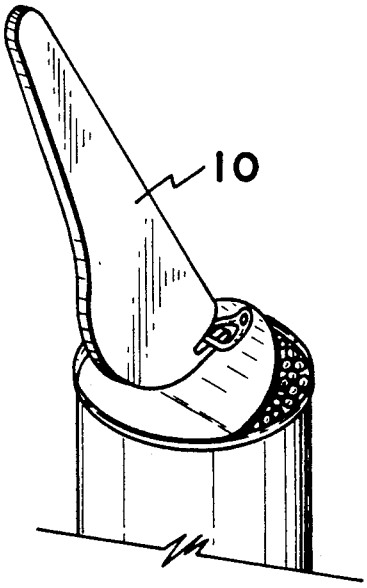
Figure 4:
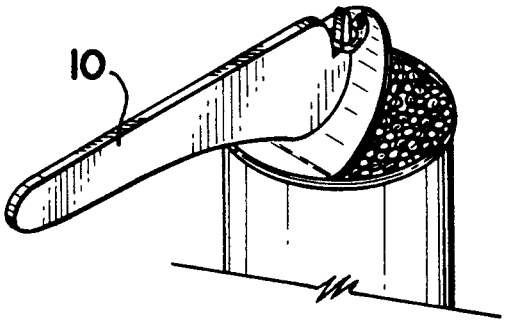

In use, the flat outer edge 18 of the can opener 10 is placed against the top lid of the container to be opened and the finger 22 is slid into the pull ring adjacent the peripheral edge of the container (See FIG. 2). Once the pull ring is engaged, the can opener is rotated downwardly using the parabolic pivoting edge 17 as a fulcrum for the opener 10. The shape of the pivoting edge 17 raises the finger 22 vertically at 90 degrees to the top of the container through the downward rotation of the handle 12 of the opener 10, thereby lifting the pull ring to sever the lid along the score line and separating the lid from the container (See FIG. 3). It will be appreciated that continued rotation of the can opener 10 on the pivoting edge 17 will further displace the lid upwardly and rearwardly until it is completely removed (See FIG. 4).

Modifications may be made to the can opener structure described above in keeping within the scope of the claims as defined hereinbelow.

I claim:

1. A tear top can opener for opening a closure lid of a container, the closure lid having a pull ring operably connected to a weakened score line, the pull ring being located adjacent the peripheral edge of the container, the opener comprising:

a handle for grasping the opener;

an intermediate bulbous shaped body portion adjacent said handle having a longitudinal axis and a parabolic shaped, pivoting edge for pivoting the opener on the container during the opening of the closure lid; and, an opener end adjacent said intermediate portion having an end edge and a slot located adjacent said end edge defining a finger integrally formed with said end edge and located perpendicular to said longitudinal axis and on the opposite side of said pivoting edge; said finger being sized for insertion into said pull ring whereby said pull ring is held in said slot during the opening operation permitting the pull ring to be lifted in a perpendicular direction to remove the closure lid when said opener is pivoted on said pivoting edge.

2. The tear top can opener of claim 1 wherein said parabolic shaped pivoting edge is defined by a gradually decreasing radius toward the opener end.

3. The tear top can opener of claim 2 wherein one end of said parabolic shaped pivoting edge extends to be coincident with said handle and the opposite end of said parabolic shaped pivoting edge extends to be coincident with said opener end edge.

4. The tear top can opener of claim 1 wherein said handle, said body portion and said opener end are integrally formed in an elongated shape.

* * * * *